US012376649B2

(12) United States Patent
Suzuki

(10) Patent No.: US 12,376,649 B2
(45) Date of Patent: Aug. 5, 2025

(54) ARTICLE OF FOOTWEAR

(71) Applicant: ASICS CORPORATION, Kobe (JP)

(72) Inventor: Chihaya Suzuki, Kobe (JP)

(73) Assignee: ASICS CORPORATION, Kobe (JP)

( * ) Notice: Subject to any disclaimer, the term of this patent is extended or adjusted under 35 U.S.C. 154(b) by 113 days.

(21) Appl. No.: 17/907,136

(22) PCT Filed: Mar. 31, 2020

(86) PCT No.: PCT/JP2020/014837
§ 371 (c)(1),
(2) Date: Sep. 23, 2022

(87) PCT Pub. No.: WO2021/199290
PCT Pub. Date: Oct. 7, 2021

(65) Prior Publication Data
US 2023/0109289 A1 Apr. 6, 2023

(51) Int. Cl.
*A43B 23/02* (2006.01)

(52) U.S. Cl.
CPC ..... *A43B 23/027* (2013.01); *A43B 23/0205* (2013.01)

(58) Field of Classification Search
None
See application file for complete search history.

(56) References Cited

U.S. PATENT DOCUMENTS 2,205,577 A * 6/1940 Roberts ..... A43B 3/126 36/51
2009/0107012 A1* 4/2009 Cheney ..... A43B 23/0235 36/25 R
2013/0212907 A1* 8/2013 Dua ..... A43B 9/00 36/83

(Continued)

FOREIGN PATENT DOCUMENTS

JP 2006-000258 A 1/2006
JP 2015-066280 A 4/2015

(Continued)

OTHER PUBLICATIONS

International Search Report issued in PCT/JP2020/014837; mailed Jun. 16, 2020.

*Primary Examiner* — Jameson D Collier
(74) *Attorney, Agent, or Firm* — Studebaker Brackett PLLC

(57) ABSTRACT

An article of footwear includes a sole and an upper. The upper includes a restrictive fabric portion. The restrictive fabric portion includes elastic and restrictive strands. A restrictive-side resistance index is greater than an elastic-side resistance index, when a tensile load is applied to the restrictive fabric portion in a direction of stretching the elastic and restrictive strands, where the restrictive-side resistance index is a ratio of an increase in tensile stress to an increase in rate of stretch of the restrictive strand, in a range in which a rate of stretch of the restrictive fabric portion is greater than a predetermined value, and the (Continued)

elastic-side resistance index is a ratio of an increase in tensile stress to an increase in rate of stretch of the elastic strand, in the range in which the rate of stretch of the restrictive fabric portion is greater than the predetermined value.

3 Claims, 16 Drawing Sheets

(56) References Cited

U.S. PATENT DOCUMENTS

| | | | | |
|---|---|---|---|---|
| 2014/0068968 | A1* | 3/2014 | Podhajny | A43B 3/0078 36/50.1 |
| 2016/0174660 | A1 | 6/2016 | Iuchi et al. | |
| 2016/0302527 | A1* | 10/2016 | Meir | A43B 23/0245 |
| 2018/0127904 | A1* | 5/2018 | Adami | D04B 1/24 |
| 2018/0263338 | A1* | 9/2018 | Amis | A43C 5/00 |
| 2018/0279720 | A1 | 10/2018 | Iuchi et al. | |
| 2019/0208862 | A1* | 7/2019 | Poegl | D04B 9/22 |
| 2019/0231021 | A1* | 8/2019 | Hoying | A43B 23/042 |
| 2019/0350303 | A1* | 11/2019 | Huffa | D04B 1/22 |
| 2020/0008530 | A1* | 1/2020 | Luedecke | D05B 35/06 |
| 2021/0219661 | A1* | 7/2021 | Line | D04B 1/123 |

FOREIGN PATENT DOCUMENTS

| | | | |
|---|---|---|---|
| JP | 6302478 | B2 | 3/2018 |
| JP | 2018-164617 | A | 10/2018 |
| WO | 2014/085205 | A1 | 6/2014 |

* cited by examiner

ARTICLE OF FOOTWEAR

TECHNICAL FIELD

The present disclosure relates to an article of footwear.

BACKGROUND ART

An article of footwear having an upper has been known. For example, Japanese Patent No. 6302478 discloses an article of footwear including an upper and a sole structure. The upper includes a knit element and an inlaid strand. The inlaid strand has a greater stretch-resistance than the stretch resistance of the knit element. In other words, the inlaid strand stretches less than the knit element. The inlaid strand can operate in connection with a lace to enhance the fit of the footwear.

CITATION LIST

Patent Literature

PTL 1: Japanese Patent No. 6302478

SUMMARY OF INVENTION

Technical Problem

It is desirable to enhance the footwear in both of the fit to a foot having been inserted in the footwear (so-called static fit) and the fit to the foot in motion (so-called dynamic fit).

It is, however, difficult to enhance both the static fit and the dynamic fit. For example, while an upper made of strands having relatively higher elasticity has enhanced static fit, the upper has degraded dynamic fit due to a smaller tensile stress of the strands. In contrast, while un upper made of strands having relatively higher kickback property has enhanced dynamic fit, the upper has degraded static fit due to a larger compression pressure on the foot.

An object of the present disclosure is to provide an article of footwear that can be enhanced in both the static fit and the dynamic fit.

Solution to Problem

An article of footwear according to an aspect of the present enclosure is an article of footwear including a sole and an upper. The upper includes a restrictive fabric portion having a function of restricting stretch, the restrictive fabric portion includes: an elastic strand that has elasticity; and a restrictive strand that has elasticity and restricts stretch of the elastic strand. A restrictive-side resistance index is greater than an elastic-side resistance index, when a tensile load is applied to the restrictive fabric portion in a direction of stretching the elastic strand and the restrictive strand, where the restrictive-side resistance index is expressed as a ratio of an amount of increase in tensile stress to an amount of increase in rate of stretch of the restrictive strand, in a range in which a rate of stretch of the restrictive fabric portion is greater than a predetermined value, and the elastic-side resistance index is expressed as a ratio of an amount of increase in tensile stress to an amount of increase in rate of stretch of the elastic strand, in the range in which the rate of stretch of the restrictive fabric portion is greater than the predetermined value.

Advantageous Effects of Invention

According to the present disclosure, an article of footwear is provided that can enhance both the static fit and the dynamic fit.

DESCRIPTION OF EMBODIMENTS

Figure 1:
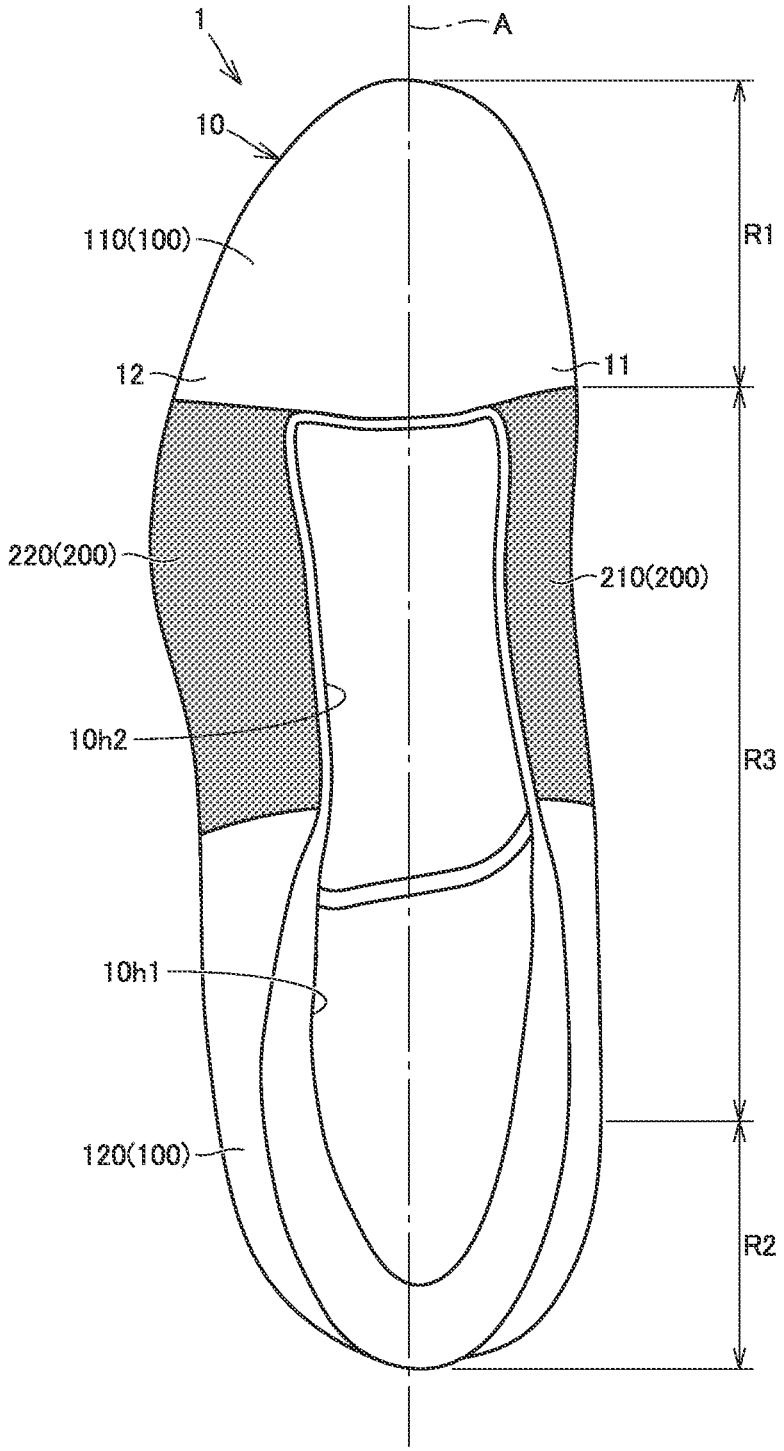
FIG. 1 is a plan view schematically showing an article of footwear according to Embodiment 1 of the present disclosure.

Embodiments of the present disclosure are described with reference to the drawings. In the drawings referenced below, the same or corresponding parts are denoted by the same reference numerals. In the following description, terms such as longitudinal direction, width direction, frontward, and rearward are used. These terms representing directions each specify a direction as seen from a viewpoint of a wearer of an article of footwear 1 placed on a flat plane such as ground. For example, frontward is toward the toe and rearward is toward the heel. Moreover, a medial foot side refers to the inner side (first-toe side) of the foot in the width direction, and a lateral foot side refers to the outer side of the foot in the width direction.

Embodiment 1

Figure 2:
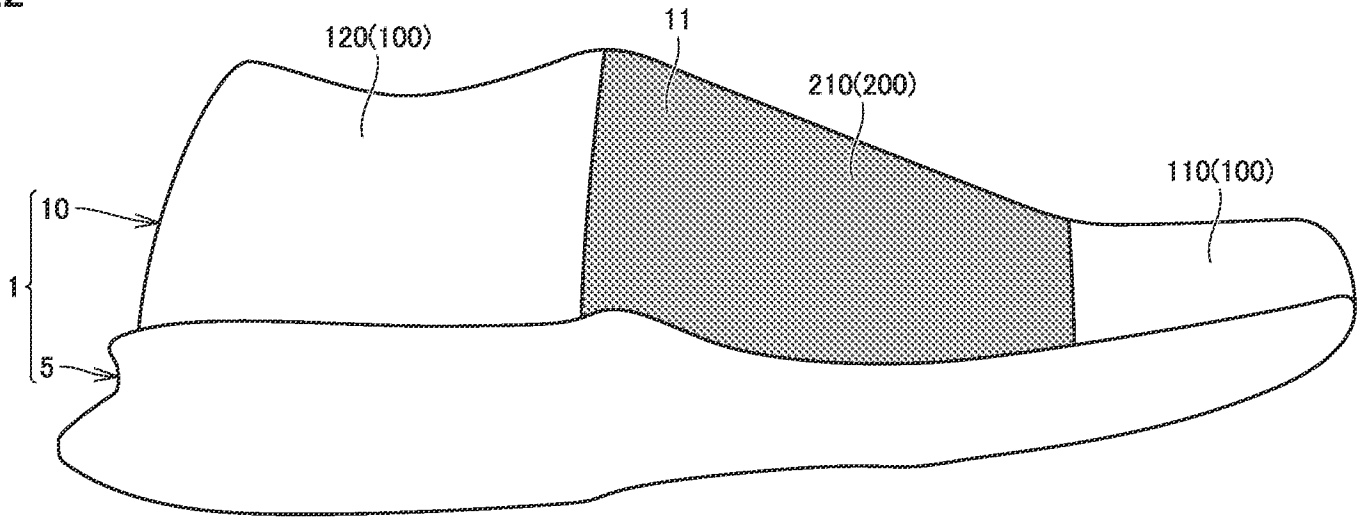
FIG. 2 is a left side view of the article of footwear shown in FIG. 1.
Figure 3:
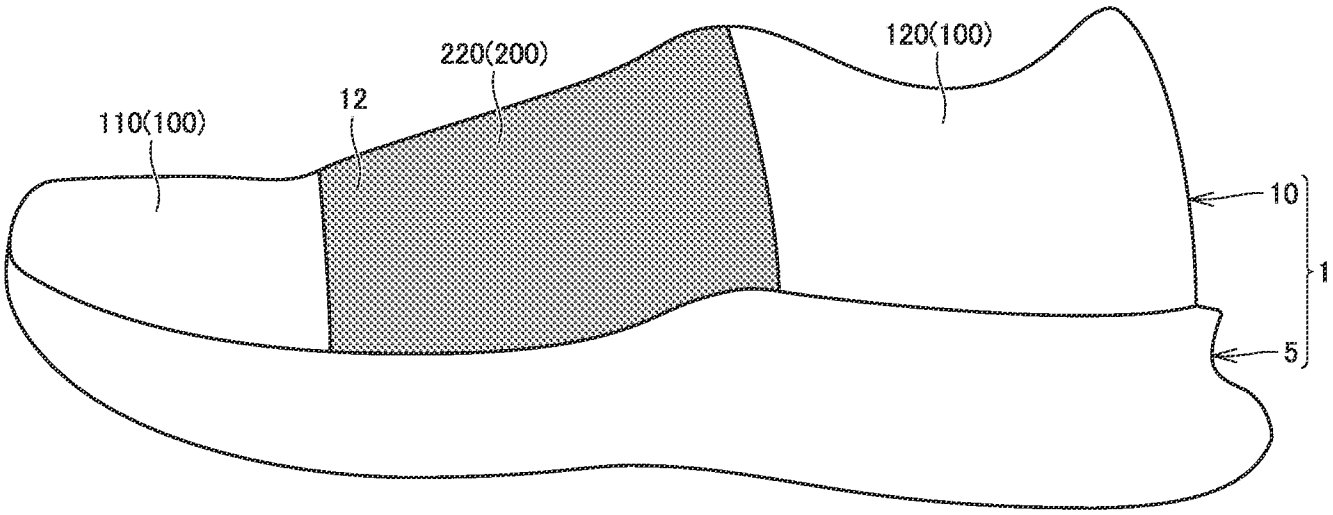
FIG. 3 is a right side view of the article of footwear shown in FIG. 1.

FIG. 1 is a plan view schematically showing an article of footwear according to Embodiment 1 of the present disclosure FIG. 2 is a left side view of the article of footwear shown in FIG. 1. FIG. 3 is a right side view of the article of footwear shown in FIG. 1. While FIGS. 1 to 3 show the article of footwear 1 for the left foot, this article of footwear 1 is applicable as well to the right foot and, in this case, this article of footwear 1 is symmetrical to the article of footwear 1 for the left foot. The article of footwear 1 according to the present embodiment is applicable, for example, for use as a sports shoe and walking shoe, and the use of the article of footwear is not limited to a particular one.

As shown in FIGS. 1 to 3, the article of footwear 1 includes a sole 5 and an upper 10.

The upper 10 is connected to the sole 5, and forms, together with the sole 5, a space for receiving a foot. The upper 10 includes a medial foot covering portion 11, a lateral foot covering portion 12, a topline 10*h*1, and a slit 10*h*2.

The medial foot covering portion 11 is a portion that covers at least a part of the medial foot surface of a foot. The medial foot covering portion 11 is formed by a portion of the upper 10 that extends inward (rightward in FIG. 1) from a centerline A extending through the center in the width direction of the article of footwear 1. The centerline A may be a line in the article of footwear 1 located to correspond to a line connecting the center of the heel bone of a foot of a standard wearer of the article of footwear 1, and a point between the first toe and the second toe of the wearer, rather than the centerline in the width direction of the article of footwear 1. While the inner side and the outer side are defined with respect to the centerline in the width direction of the article of footwear 1, this definition is not strict.

The lateral foot covering portion 12 is a part that covers at least a portion of the lateral foot surface. The lateral foot covering portion 12 is formed by a part of the upper 10 that extends outward (leftward in FIG. 1) from the centerline A.

The topline 10*h*1 is located between the medial foot covering portion 11 and the lateral foot covering portion 12 in the width direction of the article of footwear 1, for allowing a foot to be inserted and removed.

The slit 10*h*2 is an opening having a shape extending frontward from the topline 10*h*1 in the longitudinal direction of the article of footwear 1. The slit 10*h*2 is located in a midfoot region R3. The midfoot region R3 is a region located between a forefoot region R1 located frontward in the longitudinal direction of the article of footwear 1, and a rearfoot region R2 located rearward in the longitudinal direction of the article of footwear 1.

The forefoot region R1 is a region located across a range of approximately 0% to 30% with respect to the total length of the article of footwear 1 from the front end toward the rear end of the article of footwear 1. The midfoot region R3 is a region located across a range of approximately 30% to 80% with respect to the total length of the article of footwear 1 from the front end toward the rear end of the article of footwear 1. The rearfoot region R2 is a region located across a range of 80% to 100% of the total length of the article of footwear 1 from the front end toward the rear end of the article of footwear 1.

As shown in FIGS. 1 to 3, the upper 10 includes a nonstretchable fabric portion 100 and a restrictive fabric portion 200. In the following, the restrictive fabric portion 200 is described first. In each drawing, the restrictive fabric portion 200 is illustrated with a dot pattern.

Figure 4:
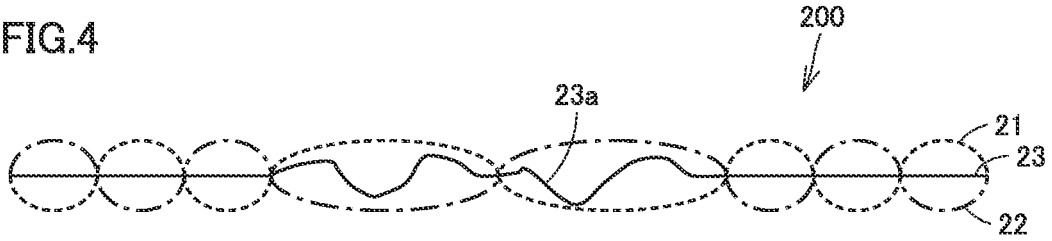
FIG. 4 is a cross-sectional view schematically showing a configuration of a restrictive fabric portion formed as a woven fabric.
Figure 5:
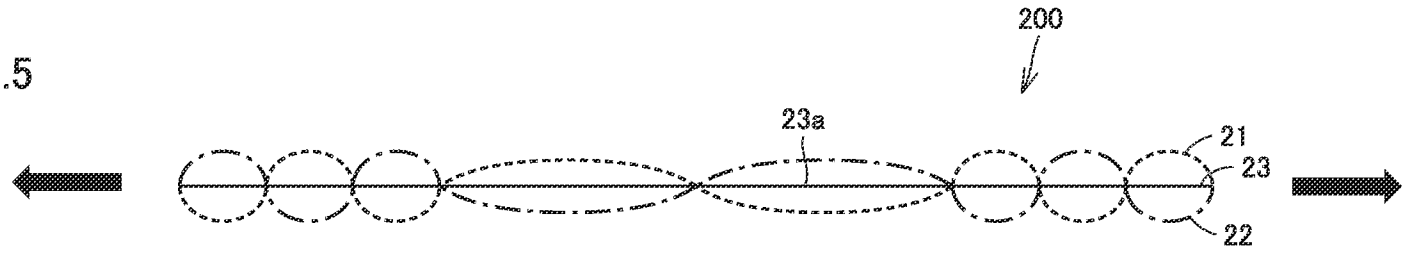
FIG. 5 is a cross-sectional view schematically showing a state in which a tensile load is applied to the restrictive fabric portion shown in FIG. 4.
Figure 6:
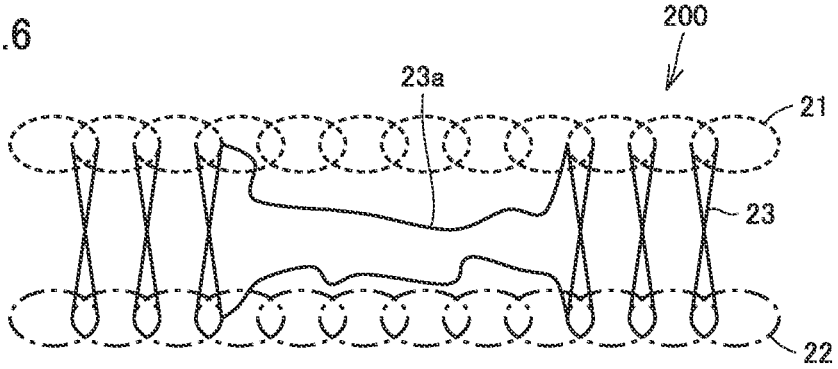
FIG. 6 is a cross-sectional view schematically showing a configuration of a restrictive fabric portion formed as a knitted fabric.
Figure 7:
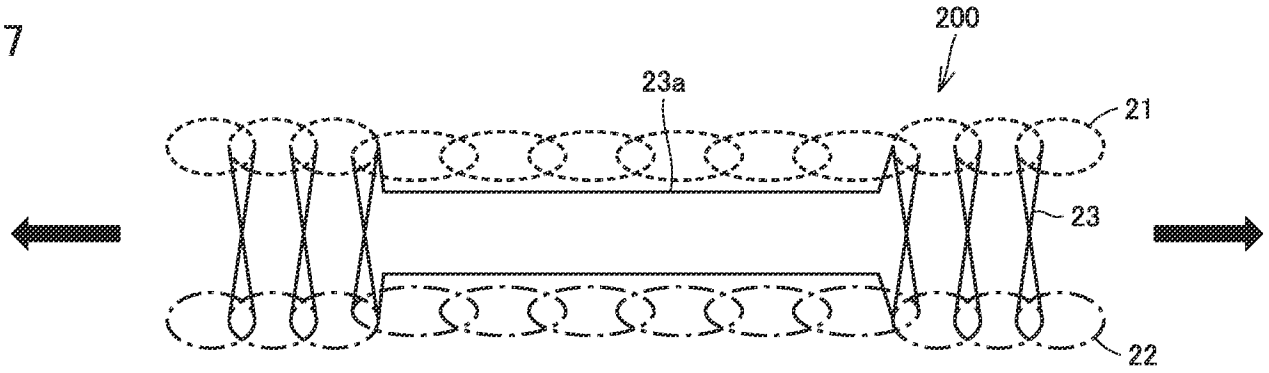
FIG. 7 is a cross-sectional view schematically showing a state in which a tensile load is applied to the restrictive fabric portion shown in FIG. 6.

The restrictive fabric portion 200 has elasticity in a certain range and has a function of restricting stretch in a range larger than this certain range. As shown in FIGS. 4 to 7, the restrictive fabric portion 200 includes elastic strands 21, 22 and a restrictive strand 23. The elastic strands 21, 22 and the restrictive strand 23 are formed integrally. The restrictive fabric portion 200 may be formed either as a woven fabric or as a knitted fabric. FIGS. 4 and 5 show a configuration of the restrictive fabric portion 200 formed as a woven fabric, and FIGS. 6 and 7 show a configuration of the restrictive fabric portion 200 formed as a knitted fabric.

The elastic strands 21, 22 include a first elastic strand 21 and a second elastic strand 22. Each of the elastic strands 21, 22 has elasticity. The first elastic strand 21 and the second elastic strand 22 may be formed as respective strands identical to each other or formed as respective strands different from each other. In FIGS. 4 to 7, for the sake of easier distinction between the first elastic strand 21 and the second elastic strand 22, the first elastic strand 21 is indicated by a broken line and the second elastic strand 22 is indicated by a dash-dotted line.

The restrictive strand 23 has elasticity and a function of restricting stretch of each of the elastic strands 21, 22. Specifically, as shown in FIG. 5 or 7, when a tensile load is applied to the restrictive fabric portion 200 in the direction of stretching the elastic strands 21, 22 and the restrictive strand 23, a restrictive-side resistance index in a range in which the rate of stretch of the restrictive fabric portion 200 is greater than a predetermined value, is greater than an elastic-side resistance index in the range in which the rate of stretch of the restrictive fabric portion 200 is greater than the predetermined value.

The elastic-side resistance index is expressed as a ratio of the amount of increase in the tensile stress to the amount of increase in the rate of stretch of the elastic strands 21, 22. The restrictive-side resistance index is expressed as a ratio of the amount of increase in the tensile stress to the amount of increase in the rate of stretch of the restrictive strand 23.

In the present embodiment, as shown in FIGS. 4 to 7, the restrictive strand 23 includes a loosening portion 23*a* that exhibits a loosening state in a range in which the rate of stretch of the restrictive fabric portion 200 is less than or equal to the aforementioned predetermined value. The loosening portion 23*a* exhibits a state of loosening to the maximum extent in the range in which the rate of stretch of the restrictive fabric portion 200 is greater than the predetermined value. Thus, the restrictive-side resistance index is greater than the elastic-side resistance index, in the range in which the rate of stretch of the restrictive fabric portion 200 is greater than the predetermined value.

In the present embodiment, the predetermined value is set to 25%. Specifically, the loosening portion 23*a* exhibits a state of loosening to the maximum extent, when the rate of stretch of the restrictive fabric portion 200 reaches 25%. The predetermined value, however, is not limited to 25%. The reason why the predetermined value has been set to 25% is that it has been found that a tensile stress at which the rate of stretch of the restrictive fabric portion 200 reaches about 25% is generated in the restrictive fabric portion 200 while a foot wearing the article of footwear 1 is in motion. Specifically, the predetermined value is set based on the tensile stress generated in the restrictive fabric portion 200 while in motion.

Figure 8:
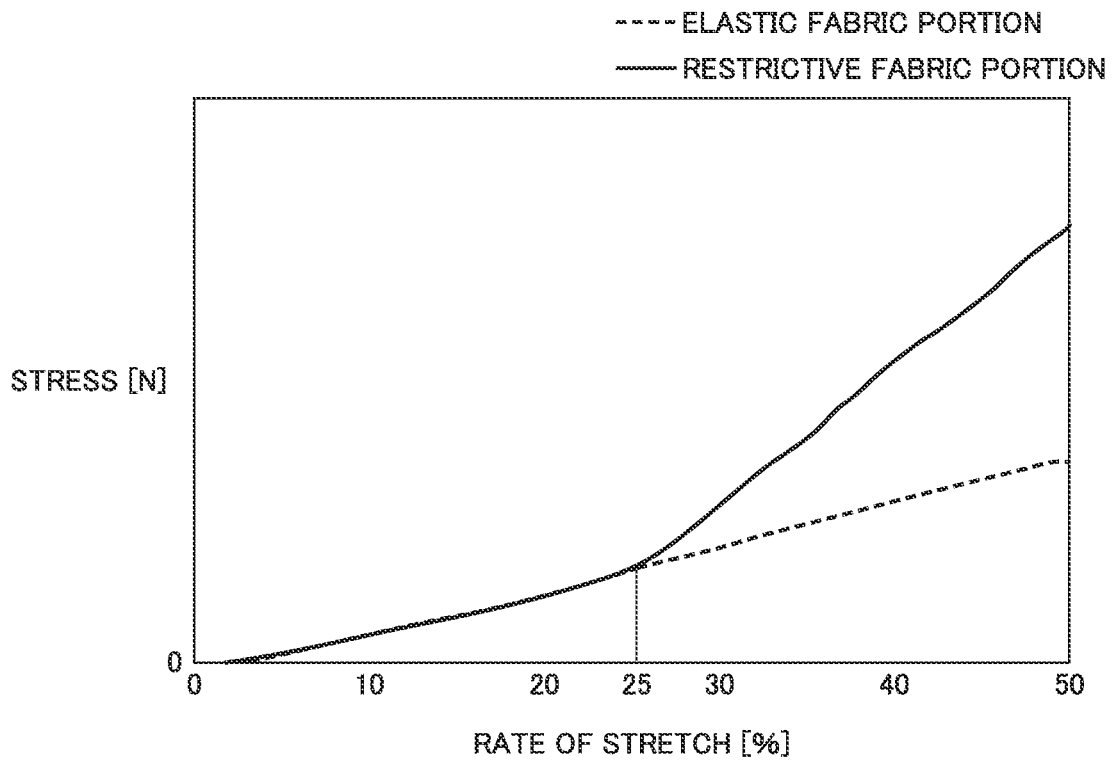
FIG. 8 is a graph showing properties of a restrictive fabric portion and an elastic fabric portion.

With reference to FIG. 8, properties of the restrictive fabric portion 200 are described. FIG. 8 shows the results of a tensile test for the restrictive fabric portion 200 and an elastic fabric portion given as a comparative example. The elastic fabric portion is made up of only the first elastic strand 21 and the second elastic strand 22.

As shown in FIG. 8, regarding the elastic fabric portion, the rate (slope) of increase in the tensile stress with respect to the amount of increase in the rate of stretch of each of the elastic strands 21, 22 is generally constant, for the rate of stretch of the elastic fabric portion falling in any range.

In contrast, the restrictive fabric portion 200 exhibits a similar behavior to that of the elastic fabric portion, in the range in which the rate of stretch is 25% or less, and exhibits the restrictive-side resistance index greater than the elastic-side resistance index, in the range in which the rate of stretch is greater than 25%. This is for the reason that the loosening portion 23*a* becomes loosened to the maximum extent when the rate of stretch of the restrictive fabric portion 200 exceeds 25%. Specifically, the loosening portion 23*a* does not substantially contribute to the value of the tensile stress, in the range in which the rate of stretch is 25% or less.

Thus, in the range in which the rate of stretch of the restrictive fabric portion 200 is 25% or less, the restrictive fabric portion 200 stretches depending on each of the elastic strands 21, 22, and therefore, the restrictive-side resistance index is substantially equal to the elastic-side resistance index and, in the range in which the rate of stretch of the restrictive fabric portion 200 is greater than 25%, the loosening portion 23*a* stretches to the maximum extent, and therefore, the restrictive strand 23 restricts stretch of the elastic strands 21, 22 and accordingly, the restrictive-side resistance index is greater than the elastic-side resistance index.

Figure 9:
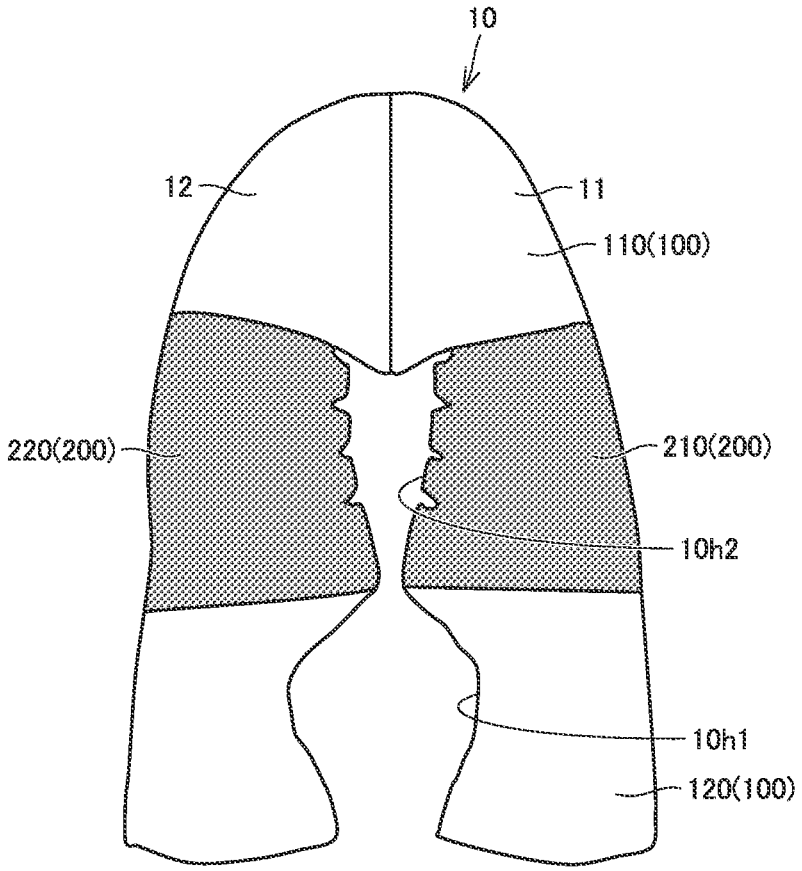
FIG. 9 is a developed view of an upper of the article of footwear shown in FIG. 1.

Next, with reference to FIG. 9, placement of the restrictive fabric portion 200 in the present embodiment is described. As shown in FIG. 9, the restrictive fabric portion 200 is placed on a side of the slit 10*h*2, i.e., placed in the midfoot region R3. Specifically, the restrictive fabric portion 200 includes a medial foot restrictive portion 210 and a lateral foot restrictive portion 220.

The medial foot restrictive portion 210 is placed on a side of the slit 10*h*2, in the medial foot covering portion 11. The medial foot restrictive portion 210 has a shape extending from an edge of the slit 10*h*2 to the sole 5 in the width direction.

The lateral foot restrictive portion 220 is placed on a side of the slit 10*h*2, in the lateral foot covering portion 12. The lateral foot restrictive portion 220 has a shape extending from an edge of the slit 10*h*2 to the sole 5 in the width direction.

In the medial foot restrictive portion 210 and the lateral foot restrictive portion 220, each of the elastic strands 21, 22 and the restrictive strand 23 is placed to extend in the width direction.

Subsequently, the nonstretchable fabric portion 100 is described. The nonstretchable fabric portion 100 includes a nonstretchable strand having a rate of stretch less than or equal to the rate of stretch of the restrictive strand 23. Therefore, a nonstretchable-side resistance index expressed as a ratio of the amount of increase in the tensile stress to the amount of increase in the rate of stretch of the nonstretchable fabric portion 100, when a tensile load is applied to the nonstretchable fabric portion 100 in the direction of stretching the nonstretchable strand, is greater than or equal to the restrictive-side resistance index, in the range in which the rate of stretch is greater than the predetermined value.

In the present embodiment, the nonstretchable strand is formed by the restrictive strand 23 that exhibits a state of stretching to the maximum extent. Therefore, the aforementioned elastic-side resistance index is equal to the restrictive-side resistance index, in the range in which the rate of stretch is greater than the predetermined value.

The nonstretchable fabric portion 100 includes a front nonstretchable portion 110 and a rear nonstretchable portion 120.

The front nonstretchable portion 110 is placed frontward of the slit 10*h*2, the medial foot restrictive portion 210, and the lateral foot restrictive portion 220. Specifically, the front nonstretchable portion 110 is placed over the entire area of the range extending from the front end of the slit 10*h*2, the front end of the medial foot restrictive portion 210, and the front end of the lateral foot restrictive portion 220, to the front end of the upper 10.

The rear nonstretchable portion 120 is placed rearward of the medial foot restrictive portion 210 and rearward of the lateral foot restrictive portion 220. Specifically, the rear nonstretchable portion 120 is placed over the whole area of the range extending from the rear end of the medial foot restrictive portion 210 and the rear end of the lateral foot restrictive portion 220, to the rear end of the upper 10.

In the front nonstretchable portion 110 and the rear nonstretchable portion 120, the nonstretchable strand is placed to extend in the width direction.

Thus, regarding the article of footwear 1 in the present embodiment, the static fit is enhanced in a static state where a foot has been inserted in the article of footwear 1, since the elastic force of the elastic strands 21, 22 allows the upper 10 to fit along the foot. Further, during motion of a foot wearing the article of footwear 1, a tensile stress at which the rate of stretch of the restrictive fabric portion 200 is equal to a predetermined value (about 25%) is generated in the restrictive fabric portion 200. In a range of the tensile stress at which the rate of stretch of the restrictive fabric portion 200 is greater than the predetermined value, the restrictive strand 23 restricts stretch of the elastic strands 21, 22, i.e., suppress movement of the foot in the article of footwear 1, which enhances the dynamic fit. The foregoing is remarkably exhibited particularly in the midfoot region R3.

Figure 10:
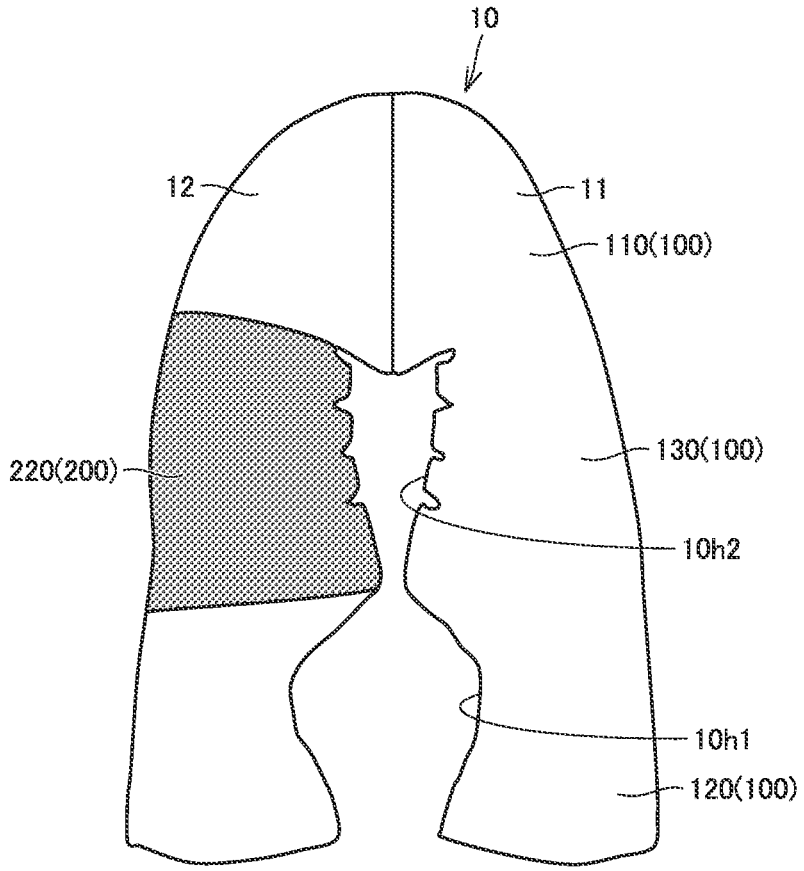
FIG. 10 is a plan view showing a modification of the upper shown in FIG. 9.

In the present embodiment, as shown in FIG. 10, the medial foot restrictive portion 210 may not be provided and the medial foot covering portion 11 may be formed entirely by the nonstretchable fabric portion 100. Specifically, the nonstretchable fabric portion 100 may have a medial foot nonstretchable portion 130 having a shape extending from an edge of the slit 10*h*2 to the sole 5 in the width direction.

Figure 11:
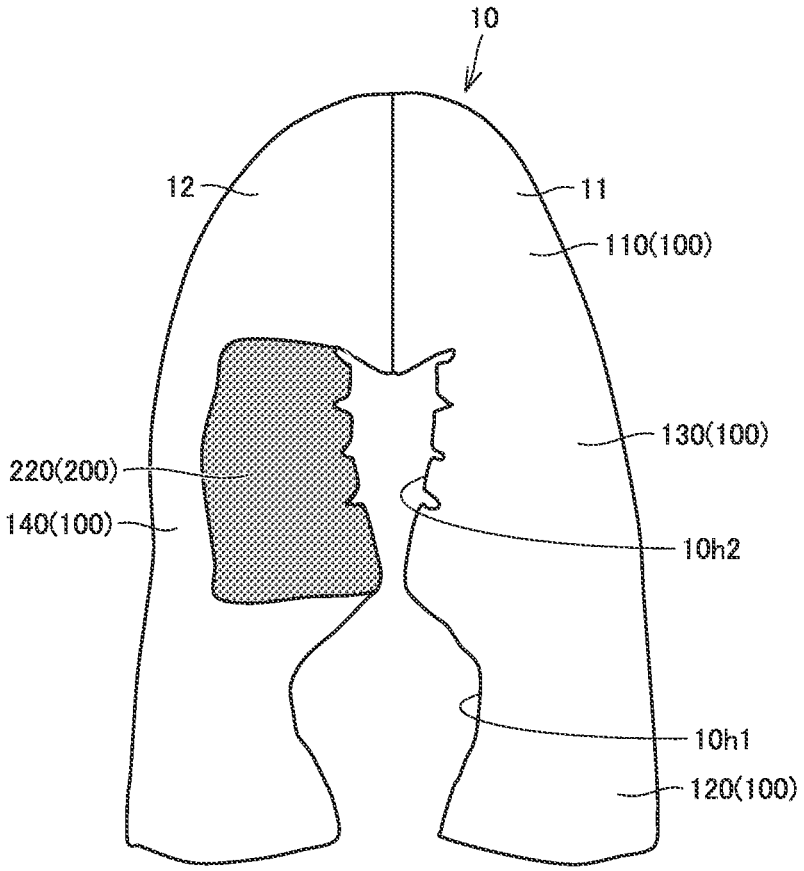
FIG. 11 is a plan view showing a modification of the upper shown in FIG. 9.

The lateral foot restrictive portion 220 may have a shape extending outward in the width direction from an edge of the slit 10*h*2 to at least a central portion between the slit 10*h*2 and the sole 5. For example, as shown in FIG. 11, the outer edge, in the width direction, of the lateral foot restrictive portion 220 may be spaced from the sole 5. In this case, the nonstretchable fabric portion 100 is placed in the portion of the lateral foot covering portion 12 that is located outward of the lateral foot restrictive portion 220. Specifically, the nonstretchable fabric portion 100 may include a lateral foot nonstretchable portion 140 placed in a portion of the lateral foot covering portion 12 that is located outward of the lateral foot restrictive portion 220. Preferably, the outer edge of the lateral foot restrictive portion 220 extends to the position that at least covers the outermost portion of the foot of the wearer. Specifically, the outer edge of the lateral foot restrictive portion 220 preferably extends to the portion corresponding to the outline of the lateral foot as seen in plan view (corresponding to FIG. 1).

Embodiment 2

Figure 12:
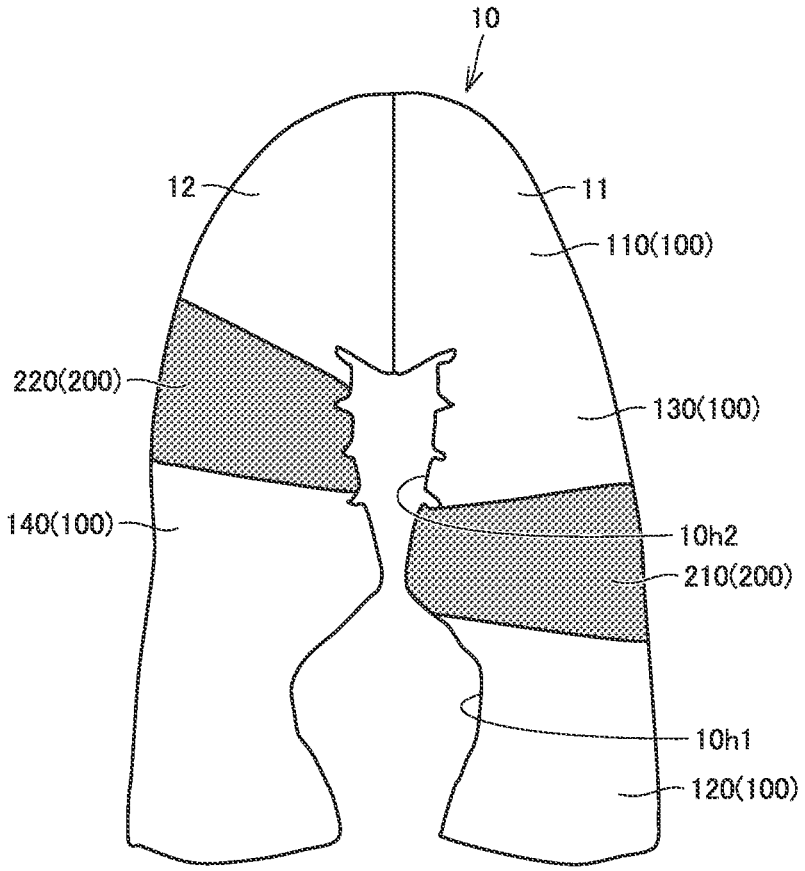
FIG. 12 is a developed view of an upper of an article of footwear according to Embodiment 2 of the present disclosure.

Next, with reference to FIG. 12, the upper 10 of the article of footwear 1 according to Embodiment 2 of the present disclosure is described. In connection with Embodiment 2, only the features different from Embodiment 1 are described, and the description of the same structures, functions, and advantageous effects as Embodiment 1 is not repeated.

In the present embodiment, the medial foot restrictive portion 210 has a shape extending in the width direction from a rear part of the slit 10*h*2 to the sole 5. The lateral foot restrictive portion 220 has a shape extending from a front part of the slit 10*h*2 to the sole 5 in the width direction.

The nonstretchable fabric portion 100 further includes a medial foot nonstretchable portion 130 and a lateral foot nonstretchable portion 140.

The medial foot nonstretchable portion 130 is placed on a side of the slit 10*h*2 and frontward of the medial foot restrictive portion 210. The medial foot nonstretchable portion 130 has a shape extending from a front part of the slit 10*h*2 to the sole 5 in the width direction.

The lateral foot nonstretchable portion 140 is placed on a side of the slit 10*h*2 and rearward of the lateral foot restrictive portion 220. The lateral foot nonstretchable portion 140 has a shape extending from a rear part of the slit 10*h*2 to the sole 5 in the width direction.

With this aspect, the restrictive fabric portion 200 is placed in the portion that is likely to crease when the upper 10 is bent, and therefore, generation of creases in this portion when the upper 10 is bent is suppressed. Accordingly, the fit to a foot in motion is enhanced.

Embodiment 3

Figure 13:
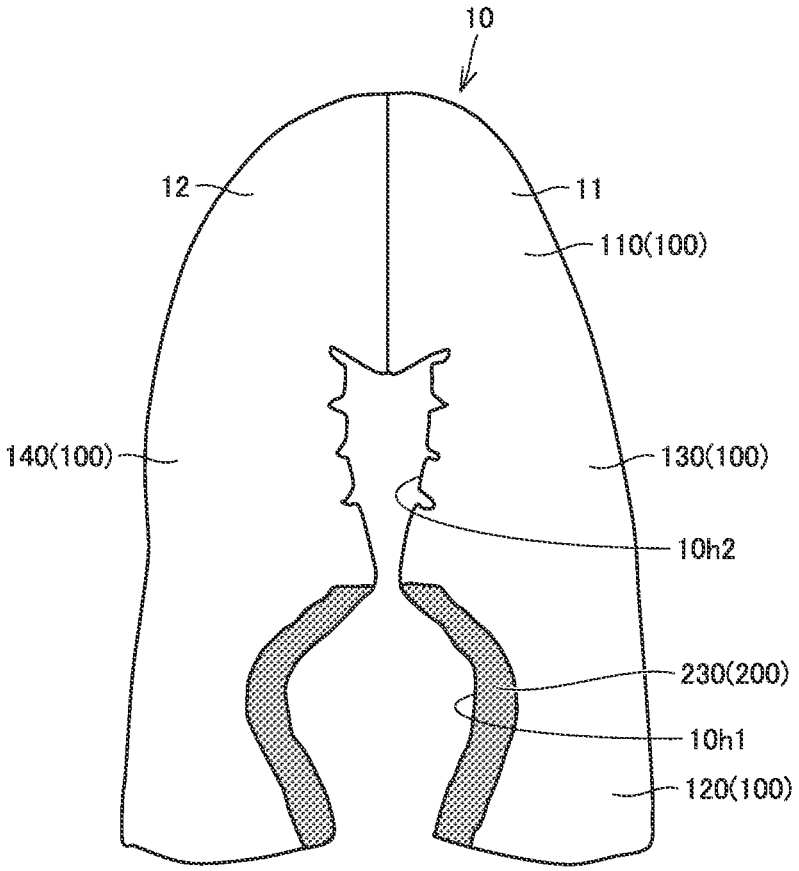
FIG. 13 is a developed view of an upper of an article of footwear according to Embodiment 3 of the present disclosure.

Next, with reference to FIG. 13, the upper 10 of the article of footwear 1 according to Embodiment 3 of the present disclosure is described. In connection with Embodiment 3, only the features different from Embodiment 1 are described, and the description of the same structures, functions, and advantageous effects as Embodiment 1 is not repeated.

In the present embodiment, the restrictive fabric portion 200 includes a topline restrictive portion 230. The topline restrictive portion 230 is placed around the topline 10*h*1.

In the upper 10, the portion other than the topline restrictive portion 230 is formed by the nonstretchable fabric portion 100. Specifically, the nonstretchable fabric portion 100 includes the front nonstretchable portion 110, the rear nonstretchable portion 120, the medial foot nonstretchable portion 130, and the lateral foot nonstretchable portion 140. The boundary between the topline restrictive portion 230 and the medial foot nonstretchable portion 130, and the boundary between the topline restrictive portion 230 and the lateral foot nonstretchable portion 140 are preferably located near the position corresponding to the lower edge of the medial malleolus and the position corresponding to the lower edge of the lateral malleolus, respectively, of the foot of a wearer. In this case, the height of the boundary of the medial foot side may be different from the height of the boundary of the lateral foot side.

With this aspect, the static fit and the dynamic fit of the topline 10*h*1 to the foot are enhanced.

Embodiment 4

Figure 14:
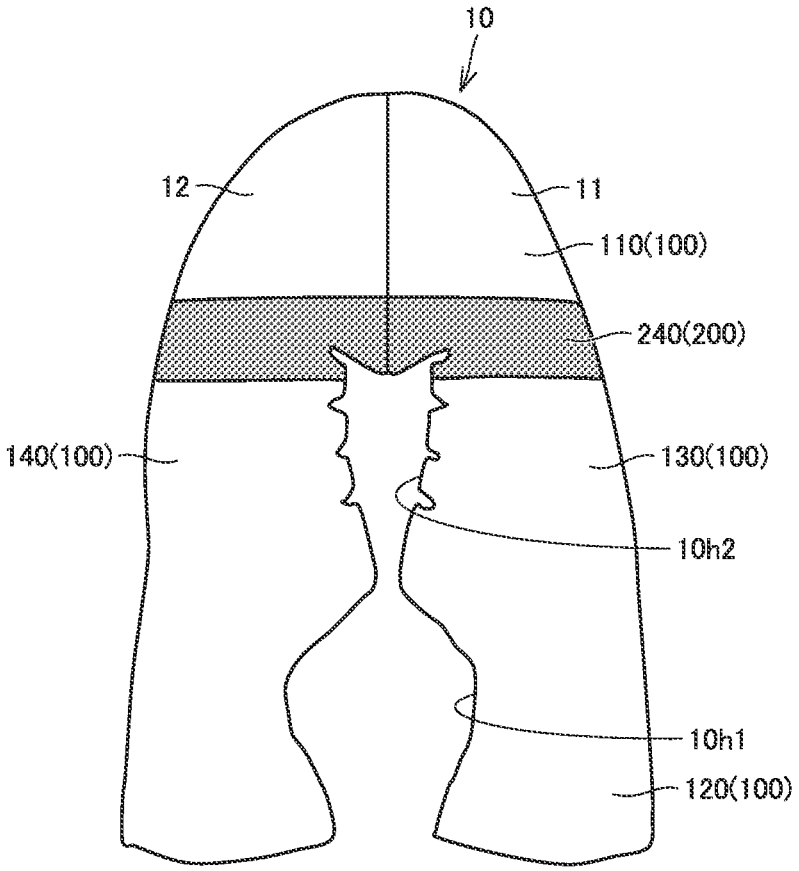
FIG. 14 is a developed view of an upper of an article of footwear according to Embodiment 4 of the present disclosure.

Next, with reference to FIG. 14, the upper 10 of the article of footwear 1 according to Embodiment 4 of the present disclosure is described. In connection with Embodiment 4, only the features different from Embodiment 1 are described, and the description of the same structures, functions, and advantageous effects as Embodiment 1 is not repeated.

In the present embodiment, the restrictive fabric portion 200 includes a front restrictive portion 240. The front restrictive portion 240 is placed at a position located frontward of the slit 10*h*2 and including a front end of the slit 10*h*2. The front restrictive portion 240 has a shape extending in the width direction.

With this aspect, the restrictive fabric portion is placed in a portion of the upper that corresponds to the MP joint of the foot, and therefore, generation of creases in this portion when the upper is bent is suppressed.

Embodiment 5

Figure 15:
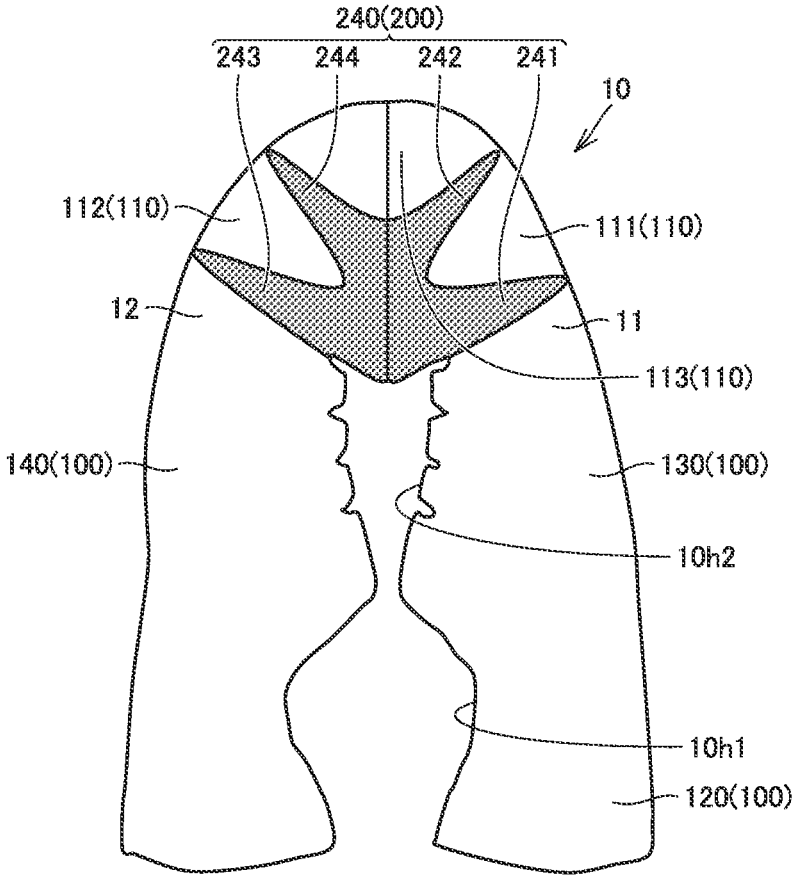
FIG. 15 is a developed view of an upper of an article of footwear according to Embodiment 5 of the present disclosure.

Next, with reference to FIG. 15, the upper 10 of the article of footwear 1 according to Embodiment 5 of the present disclosure is described. In connection with Embodiment 5, only the features different from Embodiment 1 are described, and the description of the same structures, functions, and advantageous effects as Embodiment 1 is not repeated.

In the present embodiment, the restrictive fabric portion 200 does not include the medial foot restrictive portion 210 and the lateral foot restrictive portion 220, but includes the front restrictive portion 240. The front restrictive portion 240 is placed at a position located frontward of the slit 10*h*2 and including a front end of the slit 10*h*2. The front restrictive portion 240 includes a first inner restrictive portion 241, a second inner restrictive portion 242, a first outer restrictive portion 243, and a second outer restrictive portion 244.

The first inner restrictive portion 241 has a shape extending frontward from the front end of the slit 10*h*2, toward an inner side (rightward in FIG. 15) in the width direction. The first inner restrictive portion 241 has a shape tapering such that the length in the longitudinal direction (the front-rear direction in FIG. 15) decreases toward the inner side in the width direction.

The second inner restrictive portion 242 has a shape extending away from the first inner restrictive portion 241, toward the inner side in the width direction, from an inner end, in the width direction, of the first inner restrictive portion 241 that is also a front end of the first inner restrictive portion 241. The second inner restrictive portion 242 has a shape tapering such that the length in the longitudinal direction decreases toward the inner side in the width direction.

The first outer restrictive portion 243 has a shape extending frontward from the front end of the slit 10*h*2, toward an outer side (leftward in FIG. 15) in the width direction. The first outer restrictive portion 243 has a shape tapering such that the length in the longitudinal direction decreases toward the outer side in the width direction.

The second outer restrictive portion 244 has a shape extending away from the first outer restrictive portion 243, toward the outer side in the width direction, from an inner end, in the width direction, of the first outer restrictive portion 243 that is also a front end of the first outer restrictive portion 243. The second outer restrictive portion 244 has a shape tapering such that the length in the longitudinal direction decreases toward the outer side in the width direction.

The nonstretchable fabric portion 100 further includes the medial foot nonstretchable portion 130 and the lateral foot nonstretchable portion 140. The features of the medial foot nonstretchable portion 130 and the lateral foot nonstretchable portion 140 are identical to those of Embodiment 3.

In the present embodiment, the front nonstretchable portion 110 includes an inner nonstretchable portion 111, an outer nonstretchable portion 112, and a front end nonstretchable portion 113.

The inner nonstretchable portion 111 is placed between the first inner restrictive portion 241 and the second inner restrictive portion 242.

The outer nonstretchable portion 112 is placed between the first outer restrictive portion 243 and the second outer restrictive portion 244.

The front end nonstretchable portion 113 is placed between the second inner restrictive portion 242 and the second outer restrictive portion 244.

With this aspect, both the dynamic fit when a load is applied to the upper 10 at various angles and the rigidity of the portion of the upper 10 that is located frontward of the slit **10*h*2** are ensured.

Embodiment 6

Figure 16:
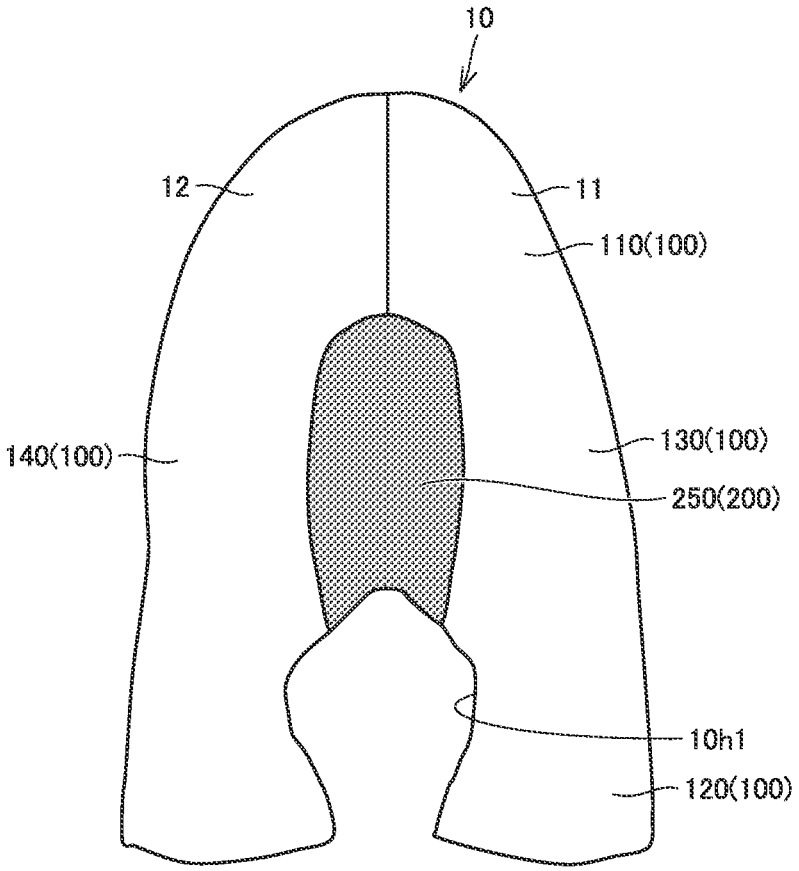
FIG. 16 is a developed view of an upper of an article of footwear according to Embodiment 6 of the present disclosure.

Next, with reference to FIG. 16, the upper 10 of the article of footwear 1 according to Embodiment 6 of the present disclosure is described. In connection with Embodiment 6, only the features different from Embodiment 1 are described, and the description of the same structures, functions, and advantageous effects as Embodiment 1 is not repeated.

In the present embodiment, the upper 10 includes the medial foot covering portion 11, the lateral foot covering portion 12, and the topline **10*h*1, and does not include the slit 10*h*2. Specifically, the upper 10** in the present embodiment is formed to have the so-called mono-sock structure.

The restrictive fabric portion 200 includes a central restrictive portion 250 placed frontward of the topline **10*h*1. The central restrictive portion 250 has a shape extending frontward from the front end of the topline 10*h*1**.

The nonstretchable fabric portion 100 includes the medial foot nonstretchable portion 130 and the lateral foot nonstretchable portion 140.

The medial foot nonstretchable portion 130 is placed on a side of the central restrictive portion 250, in the medial foot covering portion 11. The front nonstretchable portion 110, the medial foot nonstretchable portion 130, and the rear nonstretchable portion 120 are successively connected together in the longitudinal direction.

The lateral foot nonstretchable portion 140 is placed on a side of the central restrictive portion 250, in the lateral foot covering portion 12. The front nonstretchable portion 110, the lateral foot nonstretchable portion 140, and the rear nonstretchable portion 120 are successively connected together in the longitudinal direction.

It should be construed that the embodiments disclosed herein are given by way of illustration in all respects, not by way of limitation. It is intended that the scope of the present invention is defined by claims, not by the above description of the embodiments, and encompasses all modifications and variations equivalent in meaning and scope to the claims.

For example, in Embodiments 1 to 5, the slit **10*h*2 may not be provided and the upper 10 may be formed to have the so-called mono-sock structure. In this case, respective positions of the medial foot restrictive portion 210, the lateral foot restrictive portion 220, and the front restrictive portion 240 that are located around the slit 10*h*2 are identical to those when the slit 10*h*2** is provided.

[Aspects]

It is appreciated by those skilled in the art that a plurality of illustrative embodiments described above are specific examples of the following aspects.

An article of footwear 1 according to an aspect of the present disclosure is an article of footwear 1 including a sole 5 and an upper 10. The upper 10 includes a restrictive fabric portion 200 having a function of restricting stretch. The restrictive fabric portion 200 includes: an elastic strand 21, 22 that has elasticity; and a restrictive strand 23 that has elasticity and restricts stretch of the elastic strand. A restrictive-side resistance index is greater than an elastic-side resistance index, when a tensile load is applied to the restrictive fabric portion in a direction of stretching the elastic strand and the restrictive strand, where the restrictive-side resistance index is expressed as a ratio of an amount of increase in tensile stress to an amount of increase in rate of stretch of the restrictive strand 23, in a range in which a rate of stretch of the restrictive fabric portion 200 is greater than a predetermined value, and the elastic-side resistance index is expressed as a ratio of an amount of increase in tensile stress to an amount of increase in rate of stretch of the elastic strand 21, 22, in the range in which the rate of stretch of the restrictive fabric portion 200 is greater than the predetermined value.

Regarding this article of footwear, in the static state in which a foot has been inserted in the article of footwear, the static fit is enhanced since the elastic force of the elastic strand allows the upper to fit along the foot. Further, during motion of a foot wearing the article of footwear, a tensile stress at which the rate of stretch of the restrictive fabric portion is equal to a predetermined value is generated in the restrictive fabric portion. In a range of the tensile stress at which the rate of stretch of the restrictive fabric portion is greater than the predetermined value, the restrictive strand restricts stretch of the elastic strand, i.e., suppresses movement of the foot in the article of footwear, which enhances the dynamic fit.

Preferably, the restrictive strand 23 includes a loosening portion **23*a* that exhibits a loosening state in a range in which the rate of stretch of the restrictive fabric portion is less than or equal to the predetermined value, and the loosening portion 23*a*** exhibits a state of stretching to a maximum extent in the range in which the rate of stretch of the restrictive fabric portion is greater than the predetermined value, to make the restrictive-side resistance index greater than the elastic-side resistance index in the range in which the rate of stretch of the restrictive fabric portion is greater than the predetermined value.

With this aspect, the above-described advantageous effects are obtained effectively.

Preferably, the elastic strand 21, 22 and the restrictive strand 23 are formed integrally.

Preferably, the upper 10 includes: a medial foot covering portion 11 covering at least a part of a medial foot surface of a foot, a lateral foot covering portion 12 covering at least a part of a lateral foot surface of the foot; a topline **10*h*1 that is located between the medial foot covering portion and the lateral foot covering portion in a width direction of the article of footwear, and allows a foot to be inserted and removed; and a slit 10*h*2** extending frontward from the topline in a longitudinal direction of the article of footwear.

The restrictive fabric portion 200 may be placed on a side of the slit.

For example, the restrictive fabric portion 200 may include a lateral foot restrictive portion 220 placed on a side of the slit, in the lateral foot covering portion 12, and the lateral foot restrictive portion 220 may have a shape extending outward in the width direction, from an edge of the slit to at least a central portion between the slit and the sole.

With this aspect, the fit of the upper to the foot is enhanced, since the restrictive fabric portion is placed on a portion of the instep that protrudes to a relatively greater extent.

Alternatively, the restrictive fabric portion 200 may include, a medial foot restrictive portion 210 placed on a side of the slit, in the medial foot covering portion 11; and a lateral foot restrictive portion 220 placed on a side of the slit, in the lateral foot covering portion. The medial foot restrictive portion 210 has a shape extending in the width direction from a rear part of the slit to the sole, and the lateral foot restrictive portion 220 has a shape extending in the width direction from a front part of the slit to the sole.

With this aspect, the restrictive fabric portion is placed in the portion that is likely to crease when the upper is bent, and therefore, generation of creases in this portion when the upper is bent is suppressed. Accordingly, the fit to the foot in motion is enhanced.

The restrictive fabric portion 200 may include a topline restrictive portion 230 placed around the topline.

With this aspect, the static fit and the dynamic fit of the topline to the foot are enhanced.

The restrictive fabric portion 200 may include a front restrictive portion 240 placed at a position located frontward of the slit and including a front end of the slit, and the front restrictive portion 240 may have a shape extending in the width direction.

With this aspect, the restrictive fabric portion is placed in a portion of the upper that corresponds to the MP joint of the foot, and therefore, generation of creases in this portion when the upper is bent is suppressed.

In this case, the upper 10 may further include a nonstretchable fabric portion 100 including a nonstretchable strand having a rate of stretch less than or equal to the rate of stretch of the restrictive strand 23. A nonstretchable-side resistance index expressed as a ratio of an amount of increase in tensile stress to an amount of increase in rate of stretch of the nonstretchable fabric portion, when a tensile load is applied to the nonstretchable fabric portion 100 in a direction of stretching the nonstretchable strand, is greater than or equal to the restrictive-side resistance index in the range in which the rate of stretch is greater than the predetermined value. Preferably, the nonstretchable fabric portion 100 includes a front nonstretchable portion 110 placed frontward of the front restrictive portion 240.

The restrictive fabric portion 200 may include a front restrictive portion 240 placed at a position located frontward of the slit and including a front end of the slit, the front restrictive portion 240 may include: a first inner restrictive portion 241 having a shape extending frontward from the front end of the slit, toward an inner side in the width direction; a second inner restrictive portion 242 having a shape extending away from the first inner restrictive portion, toward the inner side in the width direction, from an inner end, in the width direction, of the first inner restrictive portion that is also a front end of the first inner restrictive portion; a first outer restrictive portion 243 having a shape extending frontward from the front end of the slit, toward an outer side in the width direction, and a second outer restrictive portion 244 having a shape extending away from the first outer restrictive portion, toward the outer side in the width direction, from an inner end, in the width direction, of the first outer restrictive portion that is also a front end of the first outer restrictive portion.

With this aspect, the dynamic fit when a load is applied to the upper at various angles is ensured.

In this case, preferably the first inner restrictive portion 241 has a shape tapering such that a length in the longitudinal direction decreases toward the inner side in the width direction, the second inner restrictive portion 242 has a shape tapering such that a length in the longitudinal direction decreases toward the inner side in the width direction, the first outer restrictive portion 243 has a shape tapering such that a length in the longitudinal direction decreases toward the outer side in the width direction, and the second outer restrictive portion 244 has a shape tapering such that a length in the longitudinal direction decreases toward the outer side in the width direction.

The upper 10 may further include a nonstretchable fabric portion 100 including a nonstretchable strand having a rate of stretch less than or equal to the rate of stretch of the restrictive strand, a nonstretchable-side resistance index expressed as a ratio of an amount of increase in tensile stress to an amount of increase in rate of stretch of the nonstretchable fabric portion, when a tensile load is applied to the nonstretchable fabric portion in a direction of stretching the nonstretchable strand, is greater than or equal to the restrictive-side resistance index in the range in which the rate of stretch is greater than the predetermined value, the nonstretchable fabric portion 100 may include, an inner nonstretchable portion 111 placed between the first inner restrictive portion and the second inner restrictive portion; an outer nonstretchable portion 112 placed between the first outer restrictive portion and the second outer restrictive portion; and a front end nonstretchable portion 113 placed between the second inner restrictive portion and the second outer restrictive portion.

With this aspect, both the dynamic fit when a load is applied to the upper at various angles, and the rigidity of the portion of the upper that is located frontward of the slit are ensured.

The upper may include: a medial foot covering portion covering at least a part of a medial foot surface of a foot; a lateral foot covering portion covering at least a part of a lateral foot surface of the foot; and a topline that is located between the medial foot covering portion and the lateral foot covering portion in a width direction of the article of footwear, and allows a foot to be inserted and removed, the restrictive fabric portion 200 may include a central restrictive portion 250 placed frontward of the topline, the upper 10 may further include a nonstretchable fabric portion 100 including a nonstretchable strand having a rate of stretch less than or equal to the rate of stretch of the restrictive strand, a nonstretchable-side resistance index expressed as a ratio of an amount of increase in tensile stress to an amount of increase in rate of stretch of the nonstretchable fabric portion, when a tensile load is applied to the nonstretchable fabric portion in a direction of stretching the nonstretchable strand, is greater than or equal to the restrictive-side resistance index in the range in which the rate of stretch is greater than the predetermined value, and the nonstretchable fabric portion 100 may include, a medial foot nonstretchable portion 130 placed on a side of the central restrictive portion, in the medial foot covering portion; and a lateral foot nonstretchable portion 140 placed on a side of the central restrictive portion, in the lateral foot covering portion.

REFERENCE SIGNS LIST

1 article of footwear; 5 sole; 10 upper; **10*h*1 topline; 10*h*2 slit; 11 medial foot covering portion; 12 lateral foot covering portion; 21 first elastic strand; 22 second elastic strand, 23 restrictive strand, 23***a* loosening portion; 100 nonstretchable fabric portion; 110 front nonstretchable portion; 111 inner nonstretchable portion; 112 outer nonstretchable portion; 113 front end nonstretchable portion; 120 rear nonstretchable portion; 130 medial foot nonstretchable portion; 140 lateral foot nonstretchable portion; 200 restrictive fabric portion; 210 medial foot restrictive portion; 220 lateral foot restrictive portion; 230 topline restrictive portion; 240 front restrictive portion; 241 first inner restrictive portion; 242 second inner restrictive portion; 243 first outer restrictive portion; 244 second outer restrictive portion; 250 central restrictive portion, R1 forefoot region; R2 rearfoot region; R3 midfoot region

The invention claimed is:

1. An article of footwear comprising a sole and an upper, wherein the upper includes a restrictive fabric portion having a function of restricting stretch, the restrictive fabric portion includes:

an elastic strand that has elasticity; and a restrictive strand that has elasticity and is configured to restrict stretch of the elastic strand, the restrictive strand including a loosening portion that exhibits a loosening state in a range in which a rate of stretch of the restrictive fabric portion is less than or equal to a predetermined value, wherein the restrictive fabric portion has a restrictive-side resistance index greater than an elastic-side resistance index, when a tensile load is applied to the restrictive fabric portion in a direction of stretching the elastic strand and the restrictive strand, the restrictive-side resistance index is expressed as a ratio of an amount of increase in tensile stress to an amount of increase in rate of stretch of the restrictive strand, in a range in which a rate of stretch of the restrictive fabric portion is greater than the predetermined value, the elastic-side resistance index is expressed as a ratio of an amount of increase in tensile stress to an amount of increase in rate of stretch of the elastic strand, in the range in which the rate of stretch of the restrictive fabric portion is greater than the predetermined value, the loosening portion exhibits a state of stretching to a maximum extent in the range in which the rate of stretch of the restrictive fabric portion is greater than the predetermined value, to make the restrictive-side resistance index greater than the elastic-side resistance index in the range in which the rate of stretch of the restrictive fabric portion is greater than the predetermined value, the predetermined value is 25%, and the restrictive strand and the elastic strand are each configured such that, as the rate of stretch of the restrictive fabric portion is increased from the predetermined value to 50%, a tensile stress of the restrictive strand becomes greater than a tensile stress of the elastic strand at the 50% rate of stretch.

2. The article of footwear according to claim 1, wherein the elastic strand and the restrictive strand are formed integrally.

3. The article of footwear according to claim 1, wherein the upper includes:

a medial foot covering portion configured to cover at least a part of a medial foot surface of a foot;

a lateral foot covering portion configured to cover at least a part of a lateral foot surface of the foot;

a topline that is located between the medial foot covering portion and the lateral foot covering portion in a width direction of the article of footwear, and configured to allow the foot to be inserted and removed; and a slit extending frontward from the topline in a longitudinal direction of the article of footwear.

* * * * *